United States Patent [19]

Talacko

[11] Patent Number: 4,659,019

[45] Date of Patent: Apr. 21, 1987

[54] SPRAY DEVICE FOR COATING ARTICLES WITH POWDER

[75] Inventor: Radovan Talacko, St. Gallen, Switzerland

[73] Assignee: Ransburg-Gema AG, Switzerland

[21] Appl. No.: 738,778

[22] Filed: May 29, 1985

[30] Foreign Application Priority Data

May 30, 1984 [DE] Fed. Rep. of Germany ..... 3420325

[51] Int. Cl.[4] ..... B05B 5/02

[52] U.S. Cl. ..... 239/692; 239/705

[58] Field of Search ..... 118/629, 308; 239/434.5, 690, 692, 697, 698, 704, 705, 706, 708

[56] References Cited

U.S. PATENT DOCUMENTS

| | | | |
|---|---|---|---|
| 3,819,115 | 6/1974 | Soderman | 239/698 |
| 4,090,666 | 5/1978 | Peck | 239/692 |
| 4,225,090 | 9/1980 | Kako et al. | 239/692 |
| 4,289,278 | 9/1981 | Itoh | 239/706 |
| 4,359,192 | 11/1982 | Takahashi et al. | 239/692 |

FOREIGN PATENT DOCUMENTS

| | | | |
|---|---|---|---|
| 2509851 | 9/1976 | Fed. Rep. of Germany | 239/698 |
| 134841 | 3/1979 | German Democratic Rep. | 239/704 |
| 1241593 | 8/1971 | United Kingdom | 239/698 |

*Primary Examiner*—Andres Kashnikow
*Assistant Examiner*—Mary Beth O. Jones
*Attorney, Agent, or Firm*—Ostrolenk, Faber, Gerb & Soffen

[57] ABSTRACT

A feed channel is provided upstream of a powder-spraying discharge opening in a spray device, with a pipe having an injector which coaxially surrounds such pipe length for the coaxial introduction of accelerating gas. Downstream of the injector an elongated guide member is present in the feed channel. In this way the complete cross-sectional shape of the feed channel is progressively changed along the longitudinal axis of the feed channel to a cross-sectional shape which is annular and has a smaller cross section of flow passage. This results in a further accelerating of the stream of powder. The guide member and the region of the wall of the feed channel which surrounds the guide member at a distance therefrom consists of an insulating material on which powder particles which move past are charged electrically by friction. As a result of the consequent increase in speed of powder particles in the feed channel coupled with the reduction in cross section of the feed channel, an enhanced electric charging of the powder particles is obtained over a shorter distance.

15 Claims, 1 Drawing Figure

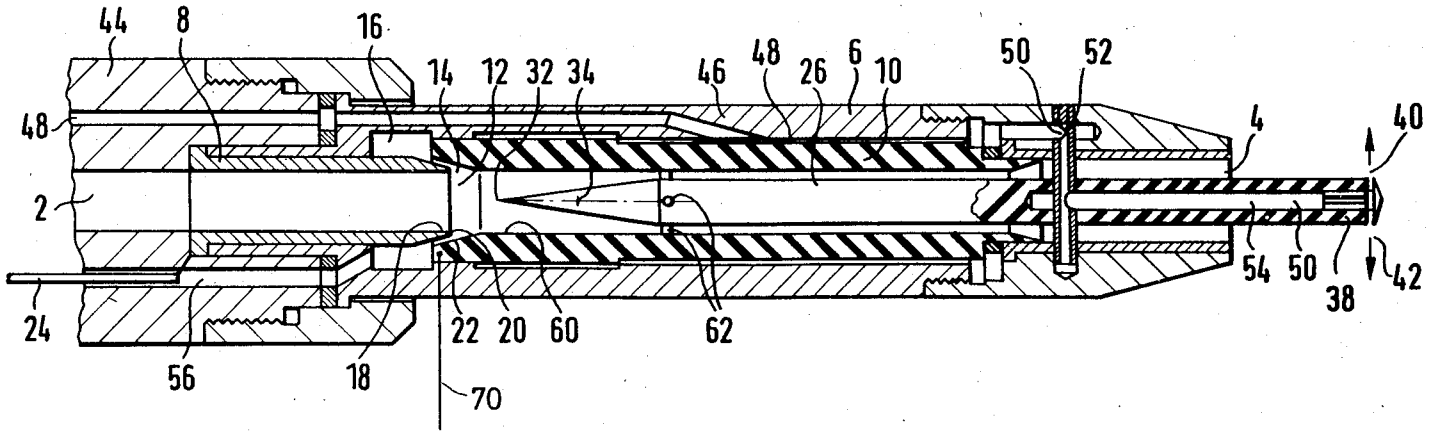
40
42
38
50
54
4
52
50
10
6
26
48
46
62
34
32
12
14
60
20
22
70
16
18
8
56
44
48
2
24

SPRAY DEVICE FOR COATING ARTICLES WITH POWDER

BACKGROUND AND SUMMARY OF THE INVENTION

The present invention relates to a spray device for coating articles with powder and, more particularly, to a spray device in which powder particles are electrokinetically charged as they are moved along a feed channel.

A spray device utilizing electrokinetic charging of powder particles is known from U.S. Pat. No. 4,090,666, which discloses a length of pipe forming a double annular-slot nozzle through whose inner channel the vehicle-gas powder stream, and through whose outer annular-slot the stream of accelerating gas, are fed. A powder spray device with electrokinetic charging of the powder is also shown in Federal Republic of Germany Pat. No. 2,347,491. Furthermore, Federal Republic of Germany No. OS 1,814,809 shows a spray device in which supplementary air is added into the stream of powder and thereupon the stream of powder and supplementary air is converted by guide vanes into an eddy flow.

The object of the present invention is to obtain a stronger electric charging of the particles of powder over a shorter path of the feed channel.

This object is achieved in accordance with the invention in a spray device in which a powder passage cross section of a feed channel changes along the axial length of the feed channel, due to an elongated guide body arranged axially at its center between injector and discharge opening, from a full cross-sectional shape to a cross-sectional shape of annular cross section with a smaller passage cross section of flow. The guide body consists of a material which electrically charges the powder by friction, and extends from close to the injector at least so far towards the discharge opening that the powder is more strongly charged electrically by friction on the guide body and the powder loses substantially no electric charge from the downstream end of the guide body up to the discharge opening.

By the invention the following effect is obtained: The stream of gas of the injector draws the vehicle-gas powder stream in the direction towards the discharge opening and accelerates it in this direction to a higher speed. The cross section of passage of the feed channel is so narrowed by the guide body that further acceleration of the gas-powder stream takes place. The higher velocity results in a stronger electrical charging of the powder particles by friction on the channel wall and on the outer surface of the guide body. At the same time, as a result of the reduction in cross section due to the guide body a stronger concentrating of the powder particles takes place, as a result of which the powder particles slide with greater force along the powder-channel wall and the surface of the guide body and are more strongly electrically charged by friction. Furthermore, the electrical charging by friction takes place not only on the inner surface of the wall of the feed channel but also on the not much smaller surface of the guide body so that there is obtained practically a doubling of the frictional surface and thus also a substantial increase in the electrical frictional charging. By the conveying action of the acceleration gas and the damming effect of the guide body, less vehicle gas is required for the conveying of the powder, and thus also less energy. Furthermore, the smaller amount of vehicle gas has a favorable effect both on the aforesaid electrical frictional charging and on the cloud of powder emerging from the discharge opening of the device or the emerging powder spray jet and on the quality of the surface coated with the powder since fewer powder particles bounce off from the article due to the smaller amount of gas.

Other features are set forth in the subordinate claims.

BRIEF DESCRIPTION OF THE DRAWING

One embodiment of the invention will be described by way of example below with reference to the sole drawing FIGURE depicting an axial longitudinal section through a spray device according to the invention.

DETAILED DESCRIPTION OF THE PREFERRED EMBODIMENT

The spray device for the coating of articles with powder which is shown in the drawing contains a feed channel 2 for the powder which is pneumatically conveyed by the stream of vehicle gas, a discharge opening 4 at the end of the feed channel 2, a channel wall or housing 6 which forms the feed channel 2 and includes a lengthwise section of a pipe 8 and, downstream thereof, of a shell 10 of insulating material which electrically charges the powder by friction and extends up to the discharge opening 4. Coaxial to the feed channel 2 there is an injector 12 for introducing an accelerating gas which coaxially surrounds the vehicle-gas powder stream and accelerates it by suction. The injector outlet 14 is an annular-slot nozzle which is formed on the downstream end of the pipe 8 between said pipe 8 and the shell 10 of insulating material. The pipe 8 separates the feed channel 2 from an annular chamber 16 which surrounds said channel. The outer periphery of the downstream end 18 of the pipe 8 is so tapered frustoconically in the direction of flow that the edge of this downstream pipe end terminates sharply in the form of an annular knife edge 20. Opposite the frustoconically tapered end-section 18 of the pipe 8 and at a small distance from it there is a frustoconically shaped initial section 22 of the shell 10 of insulating material. The downstream end of initial section 22 is in the shape of a cone vertex for injector outlet 14. The two parts 18 and 22 form between each other the annular slot of the injector outlet 14 which comprises an annular-slot nozzle and which extends, in the longitudinal section shown in the drawing, at an angle of between 15° and 90°, and preferably at an angle of less than 45°, to the longitudinal axis of the feed channel 2. The pipe 8 is connected via an electric wire 24 to an electric potential, preferably ground potential.

In the center of the feed channel 2 there is axially arranged an elongated guide body 26 which extends essentially over the length of the shell 10 of insulating material from a point near the downstream end-section 18 of the pipe 8 up to the discharge opening 4 and, in the same way as the shell 10 of insulating material, consists of an electrically insulating material which electrically charges by friction particles of powder which rub along it. The upstream end-section 30 of the guide body 26 is conically tapered in the upstream direction. The tip 32 of the cone lies between the annular knife edge 20 of the pipe 8 and the angle vertex 34 of the annular slot 14 of the injector outlet.

The downstream end 38 of the guide body 26 is extended axially beyond the discharge opening 4 and is provided at its end with a radial annular-slot nozzle 40 for producing a gas-curtain 42 which discharges substantially in ray form radially. The gas curtain 42 acts as a "pneumatic baffle body" on which the gas-powder mixture of the feed channel 2 impinges and is converted into a cloud of powder which then flows further in the direction of the flow of the feed channel 2 onto an article which is to be coated. The feeding of the gas for the gas-curtain 42 is effected via a channel 48 which extends parallel to the feed channel 2 in housing parts 44 and 46, an adjoining annular channel 48 formed between the housing part 46 and the insulating-material shell 10, via boreholes 50 in braces 52 which hold the guide member 26 in the feed channel 2, to an axial bore 54 in the guide body 26 and from there to the annular-slot nozzle 40. Instead of an annular-slot nozzle 40 for producing a gas curtain 42, a known mechanical baffle member could also be provided.

The feeding of the accelerating gas into the annular chamber 16 is effected via another channel 56 in the housing part 44. The electric wire 24 for the pipe 8 is also passed through this gas channel 56, the pipe consisting of an electrically conductive or at least semiconductive material.

Whether the powder particles are charged positively or negatively by removal of anions or cations, respectively, depends on the nature of the powder material and of the material of the insulating-material shell adapted thereto as well as of the guide member 26, which consists of insulating material. The concentration of charge on the inner shell surface increases with the opposite electric charging of the powder particles and after a short time reaches a certain saturation which impedes further electric charging of the powder particles. In the device of the invention the electric charge of the insulating-material shell 10 travels in an upstream directio as far as the knife edge 20. At that point the electric charge flows through the powder stream to bridge the gap to pipe 8. Thereupon, the electric charge is removed from the electrically conductive pipe 8 via the electric wire 24 connected thereto. In this way, the aforesaid saturation of cations or anions between the insulating-material shell 10 and the guide member 26 is avoided so that the maximum possible charging by friction of the following powder particles continuously takes place. The insulating-material shell 10 may consist of several parts.

The guide member 26 is preferably also connected via the electric wire 24 or a separate wire, for example wire 70, to a corresponding electric potential, preferably ground potential. As shown in the drawing, this connection can be effected indirectly in the manner that the guide body 26 is connected to the insulating-material shell 10 via pins 62 which hold the guide body in the feed channel 2.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A pneumatic spray device for coating articles with powder, comprising:

a feed channel housing in which a feed channel is provided for the flow of a stream of vehicle gas and powder therethrough, the feed channel housing having a discharge opening situated at a downstream end of the feed channel, said feed channel housing including a lengthwise section of a pipe, and downstream of said pipe, a shell of insulating material adapted to electrically charge the powder by friction and extending to or close to said discharge opening;

an injector with an outlet situated at the downstream end of the pipe, arranged coaxially in the feed channel, and adapted to introduce into the feed channel an accelerating gas which coaxially surrounds the vehicle-gas powder stream and accelerates it by suction; and an elongated guide body aligned in the axial center of the feed channel between the injector and the discharge opening, said guide body being configured in such a way that the powder passage cross section of the feed channel changes along the longitudinal axis of the feed channel in the downstream direction from a full cross sectional shape to an annular cross sectional shape with a smaller cross section of flow passage, the guide body having an upstream end section which is conically tapered in the upstream direction and which extends to the injector and a main body downstream of the upstream end section, said powder passage cross-section being defined between the guide body and the shell and the cross-sectional sizes of the guide body and the shell being such that the powder passage cross-section changes gradually from a full cross-section at the upstream end of the conically tapered portion of the guide body to a continuously decreasing annular cross-section along the conically tapered portion of the guide body and remains at a substantially constant annular cross-section along the main body, the guide body comprising a material adapted to electrically charge the powder by friction, and the guide body extending from close to the injector at least so far towards the discharge opening that the powder flowing through the feed channel is charged electrically by friction on the guide body and loses substantially no electrical charge over the distance from the downstream end of the guide body up to the discharge opening.

2. A device according to claim 1, wherein the guide body extends at least up to the discharge opening.

3. A device according to claim 2, wherein the guide body includes a deflection element on its downstream end for the spraying of the powder of the vehicle-gas powder stream.

4. A device according to claim 1, wherein the injector includes an annular chamber which surrounds the feed channel and from which the injector outlet leads to the feed channel.

5. A device according to claim 4, wherein the injector outlet comprises an annular-slot nozzle with an annular slot formed between the downstream end-section of the pipe and a confronting part of the wall of the feed channel which is spaced therefrom and comprises a funnel-shaped initial section of the shell of insulating material.

6. A device according to claim 1, wherein the injector outlet defines an annular slot which is inclined at an angle of between 15° to 90° relative to the longitudinal axis of the feed channel.

7. A device according to claim 1, wherein the downstream end of the guide body extends axially beyond the discharge opening and includes a radial annular slot nozzle for producing a gas-curtain effective for creating a pneumatic baffle body on which the gas-powder mixture emanating from the feed channel impinges to be converted into a cloud of powder which continues to flow along the downstream direction defined in the feed channel.

8. A pneumatic spray device for coating articles with powder, comprising:

a feed channel housing in which a feed channel is provided for the flow of a stream of vehicle gas and powder therethrough, the feed channel housing having a discharge opening situated at a downstream end of the feed channel, said feed channel housing including a pipe, and downstream of said pipe, a shell of insulating material adapted to electrically charge the powder by friction and extending to or close to said discharge opening;

an injector with an outlet situated at the downstream end of the pipe, arranged coaxially in the feed channel, and adapted to introduce into the feed channel an accelerating gas which coaxially surrounds the vehicle-gas powder stream and accelerates it by suction; and an elongated guide body aligned in the axial center of the feed channel between the injector and the discharge opening, said guide body being configured in such a way that the powder passage cross section of the feed channel changes along the longitudinal axis of the feed channel in the downstream direction from a full cross sectional shape to an annular cross sectional shape with a smaller cross section of flow passage, the guide body having an upstream end section which is conically tapered in the upstream direction and which extends to the injector and a main body downstream of the upstream end section, said powder passage cross-section being defined between the guide body and the shell and the cross-sectional sizes of the guide body and the shell being such that the powder passage cross-section changes gradually from a full cross-section at the upstream end of the conically tapered portion of the guide body to a continuously decreasing annular cross-section along the conically tapered portion of the guide body and remains at a substantially constant annular cross-section along the main body, the guide body comprising a material adapted to electrically charge the powder by friction, and the guide body extending from close to the injector at least so far towards the discharge opening that the powder flowing through the feed channel is charged electrically by friction on the guide body and loses substantially no electrical charge over the distance from the downstream end of the guide body up to the discharge opening; and wherein said pipe is comprised of material which is at least electrically semiconductive and is connected to a conductor adapted to be provided with a given electric potential.

9. A device according to claim 8, wherein the downstream end-section of the pipe terminates in the shape of an annular knife edge.

10. A device according to claim 9, wherein the upstream end of the guide body lies axially between the downstream end of the pipe and a cone vertex point of the injector outlet.

11. A device according to claim 8, wherein the injector outlet comprises a slot nozzle which is inclined toward the longitudinal axis of the feed channel at an angle of between 15° to 90° with respect to the longitudinal axis of the feed channel.

12. A device according to claim 8, wherein the section of the feed channel located directly upstream of the guide body is comprised of material which is at least electrically semiconductive, the material being connected to a conductor intended to be connected to a given electrical potential.

13. A pneumatic spray device for coating articles with powder, comprising:

a feed channel housing in which a feed channel is provided for the flow of a stream of vehicle-gas and powder therethrough, a downstream end of the feed channel comprising a discharge opening;

an elongated guide body located axially in the feed channel, configured in such a way that the feed channel has an annular powder passage cross section along said guide body, and comprising a material adapted to electrically charge the powder by friction;

a section of the feed channel located directly upstream of the guide body having a full cross-sectional shape, said section of annular cross section having a smaller flow passage cross-section than the section having a full cross-sectional shape; and an injector with an outlet opening into the feed channel, being situated upstream of the guide member, and being adapted to introduce an acceleration gas axially surrounding the stream of powder and accelerating it in the direction towards the guide body;

the guide body having an upstream end section which is conically tapered in the upstream direction and which extends to the injector and a main body downstream of the upstream end section, said powder passage cross-section being defined between the guide body and the feed channel housing and the cross-sectional sizes of the guide body and the feed channel housing being such that the powder passage cross-section changes gradually from a full cross-section at the upstream end of the conically tapered portion of the guide body to a continuously decreasing annular cross-section along the conically tapered portion of the guide body and remains at a substantially constant annular cross-section along the main body.

14. A device according to claim 13, wherein the section of the feed channel located directly upstream of the guide body is comprised of material which is at least electrically semiconductive, the material being connected to a conductor intended to be connected to a given electrical potential.

15. A device according to claim 14, wherein the injector outlet comprises a slot nozzle which is inclined toward the longitudinal axis of the feed channel at an angle of between 15° to 90° with respect to the longitudinal axis of the feed channel.

* * * * *